US011168550B2

(12) United States Patent
Michalec et al.

(10) Patent No.: US 11,168,550 B2
(45) Date of Patent: Nov. 9, 2021

(54) SEAL CONFIGURATION FOR DOWNHOLE RECIPROCATING PUMPS

(71) Applicant: Baker Hughes Oilfield Operations LLC, Houston, TX (US)

(72) Inventors: Aaron Michalec, Ventura, CA (US); Remigio Quinto, Red Deer (CA); Joseph Ford, Edmond, OK (US); Girish Kshirsagar, Edmond, OK (US)

(73) Assignee: Ravdos Holdings Inc., New York, NY (US)

( * ) Notice: Subject to any disclaimer, the term of this patent is extended or adjusted under 35 U.S.C. 154(b) by 0 days.

(21) Appl. No.: 16/792,023

(22) Filed: Feb. 14, 2020

(65) Prior Publication Data

US 2020/0263523 A1 Aug. 20, 2020

Related U.S. Application Data

(60) Provisional application No. 62/805,925, filed on Feb. 14, 2019.

(51) Int. Cl.
*E21B 43/12* (2006.01)

(52) U.S. Cl.
CPC ..... *E21B 43/127* (2013.01)

(58) Field of Classification Search
CPC ..... E21B 43/13; E21B 43/121; E21B 43/126; E21B 43/127
See application file for complete search history.

(56) References Cited

U.S. PATENT DOCUMENTS 3,765,483 A * 10/1973 Vencil ..... E21B 43/14 166/265
5,005,651 A 4/1991 Burrows
6,173,768 B1 1/2001 Watson
6,196,312 B1 3/2001 Collins et al.
2002/0007952 A1 1/2002 Vann
2003/0037929 A1* 2/2003 Leniek, Sr. ..... E21B 43/127 166/369
2005/0226752 A1* 10/2005 Brown ..... E21B 43/126 417/555.1
2011/0097217 A1* 4/2011 Williams ..... F04B 47/026 417/53
2011/0284238 A1 11/2011 Berry et al.
2012/0292045 A1* 11/2012 Krawiec ..... E21B 33/12 166/377

OTHER PUBLICATIONS

ISA/US; International Search Report and Written Opinion for PCT/US20/18417 dated May 7, 2020.

* cited by examiner

*Primary Examiner* — David Carroll

(74) *Attorney, Agent, or Firm* — Dentons Cohen & Grigsby P.C

(57) ABSTRACT

A downhole reciprocating pump configured for deployment within a tubing string. The reciprocating pump includes a pump barrel, a plunger inside the pump barrel, a lower seating nipple connected within a lower portion of the tubing string and a lower hold-down connected to the pump barrel. The lower hold-down is configured for a mechanical latching engagement with the lower seating nipple. The reciprocating pump also includes an upper seating nipple connected within the tubing string above the lower seating nipple. The upper seating nipple is longer than the lower seating nipple. The reciprocating pump further includes an upper hold-down that has one or more seals that contact an interior surface of the upper seating nipple.

16 Claims, 3 Drawing Sheets

SEAL CONFIGURATION FOR DOWNHOLE RECIPROCATING PUMPS

RELATED APPLICATIONS

This application claims the benefit of U.S. Provisional Patent Application Ser. No. 62/805,925 filed Feb. 14, 2019, entitled "Improved Seal Configuration for Downhole Reciprocating Pumps," the disclosure of which is herein incorporated by reference.

FIELD OF THE INVENTION

This invention relates generally to oilfield equipment and in particular to an improved downhole reciprocating pumping system.

BACKGROUND

Hydrocarbons are produced from wells, which will eventually be assisted with artificial lift systems. Rod lift pumping systems, which are sometimes referred to as "walking-beam pump systems" or "beam pumping units," recover wellbore fluids with a reciprocating downhole plunger that is connected to a surface pumping unit by a rod string. There are two basic types of downhole reciprocating pumps. In tubing pumps, the production tubing itself provides the chamber in which the plunger reciprocates. In contrast, insert pumps include a separate pump barrel that is deployed through the production tubing. In an insert pump, the plunger reciprocates within the stationary pump barrel. Insert pumps tend to be favored for the ability retrieve and service the pump without pulling the entire production tubing string.

Insert pumps typically include a barrel, a seating assembly, a plunger, a standing valve and a traveling valve. The plunger is connected to a rod string that is raised and lowered by the beam pumping unit or other surface-based lifting mechanism. As the plunger reciprocates within the stationary pump barrel, it lifts fluids to the surface through the production tubing. The standing valve and traveling valve cooperate to fill and evacuate the pump barrel with the reciprocating motion of the plunger.

The seating assembly typically includes a seating nipple installed in the tubing string at a desired depth. Mechanical or cup hold-downs are used to secure the reciprocating pump m position within the production tubing while the pump is operational. The hold-downs may be positioned at the top or bottom of the reciprocating pump. Prior art hold-downs include a "no-go" shoulder that prevents the hold-downs from passing through the seating nipples installed within the production tubing. Because the seating nipples are fixed in position within the production tubing, the hold-downs must be precisely positioned within the pump to match the spacing of the seating nipples within the production tubing.

The various components of the reciprocating pump are designed to be retrieved through the production tubing by disconnecting the pump from the seating nipples in the production tubing. In some cases, however, sand, scale and other particulate solids become impacted between the pump and the production tubing, thereby frustrating efforts to retrieve the pump through the production tubing. The problems associated with the impaction of sand between the pump and the production tubing are exacerbated by installations exceeding 7,000 feet in depth. If the pump cannot be separated from the production tubing, the entire production tubing string must be removed from the well, thereby significantly increasing the costs associated with servicing the pump.

Accordingly, there is a need for an improved insert pumping system that is less susceptible to becoming jammed in the production tubing with sediment. It is to these and other deficiencies in the prior art that the present invention is directed.

SUMMARY OF THE INVENTION

In one aspect, the invention includes a downhole reciprocating pump configured for deployment within a tubing string. The reciprocating pump includes a pump barrel, a plunger inside the pump barrel, a lower seating nipple connected within a lower portion of the tubing string and a lower hold-down connected to the pump barrel. The lower hold-down is configured for a mechanical latching engagement with the lower seating nipple. The reciprocating pump also includes an upper seating nipple connected within the tubing string above the lower seating nipple. The upper seating nipple is longer than the lower seating nipple. The reciprocating pump further includes an upper hold-down that has one or more seals that contact an interior surface of the upper seating nipple.

In another aspect, the present invention includes a method for servicing a reciprocating downhole pump. The method can begin with the step of installing upper and lower seating nipples at fixed locations within a tubing string. The method continues with the step of deploying a reciprocating pump inside the tubing string, where the reciprocating pump comprises a first pump barrel, an upper hold-down and a lower hold-down. The method continues with the step of securing the reciprocating pump at a position within the tubing string by locking the lower hold-down within the lower seating nipple. The method continues with the step of sealing an annular space surrounding the reciprocating pump with a sealing engagement between the upper hold-down and the upper seating nipple, where the upper hold-down engages the upper seating nipple in a second location.

WRITTEN DESCRIPTION

Figure 1:
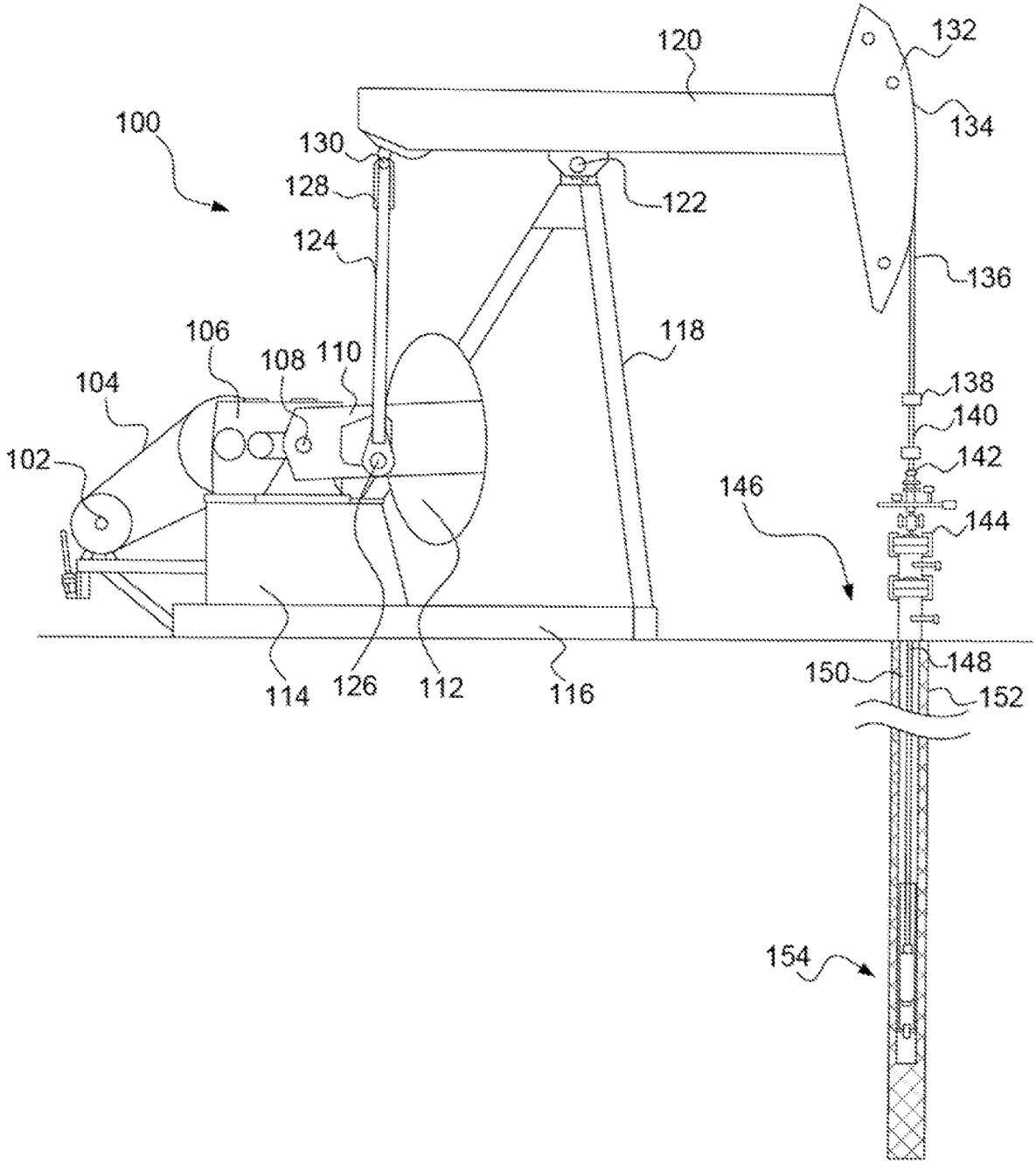
FIG. 1 is a side view of a beam pumping unit and well head.

FIG. 1 shows a beam pumping unit 100 constructed in accordance with an exemplary embodiment of the present invention. The beam pumping unit 100 is driven by a prime mover 102, typically an electric motor or internal combustion engine. The rotational power output from the prime mover 102 is transmitted by a drive belt 104 to a gearbox 106. The gearbox 106 provides low-speed, high-torque rotation of a crankshaft 108. Each end of the crankshaft 108 (only one is visible in FIG. 1) carries a crank arm 110 and a counterbalance weight 112. The gearbox 106 sits atop a sub-base or pedestal 114, which provides clearance for the crank arms 110 and counterbalance weights 112 to rotate. The gearbox pedestal 114 is mounted atop a base 116. The base 116 also supports a Samson post 118. The top of the Samson post 118 acts as a fulcrum that pivotally supports a walking beam 120 via a center bearing assembly 122.

Each crank arm 110 is pivotally connected to a pitman arm 124 by a crank pin bearing assembly 126. The two pitman arms 124 are connected to an equalizer bar 128, and the equalizer bar 128 is pivotally connected to the rear end of the walking beam 120 by an equalizer bearing assembly 130, commonly referred to as a tail bearing assembly. A horse head 132 with an arcuate forward face 134 is mounted to the forward end of the walking beam 120. The face 134 of the horse head 132 interfaces with a flexible wire rope bridle 136. At its lower end, the bridle 136 terminates with a carrier bar 138, upon which a polish rod 140 is suspended. The polish rod 140 extends through a packing gland or stuffing box 142 on a wellhead 144 above a well 146. A sucker rod string 148 hangs from the polish rod 140 within a string of production tubing 150 located within a well casing 152. The sucker rod string 148 drives a reciprocating pump 154.

Although a beam pumping unit 100 is depicted in FIG. 1, it will be appreciated that the reciprocating pump 154 can also be driven by other types of linear actuators, including pneumatic and mechanical actuators that are configured to raise and lower the sucker rod string 148 to drive the reciprocating pump 154. Accordingly, as used herein, the term "linear actuator" refers to any device that is configured to drive the reciprocating pump 154, including the beam pumping unit 100 and hydraulic, pneumatic and mechanical units that are configured to raise and lower the sucker rod string 148.

Figure 2:
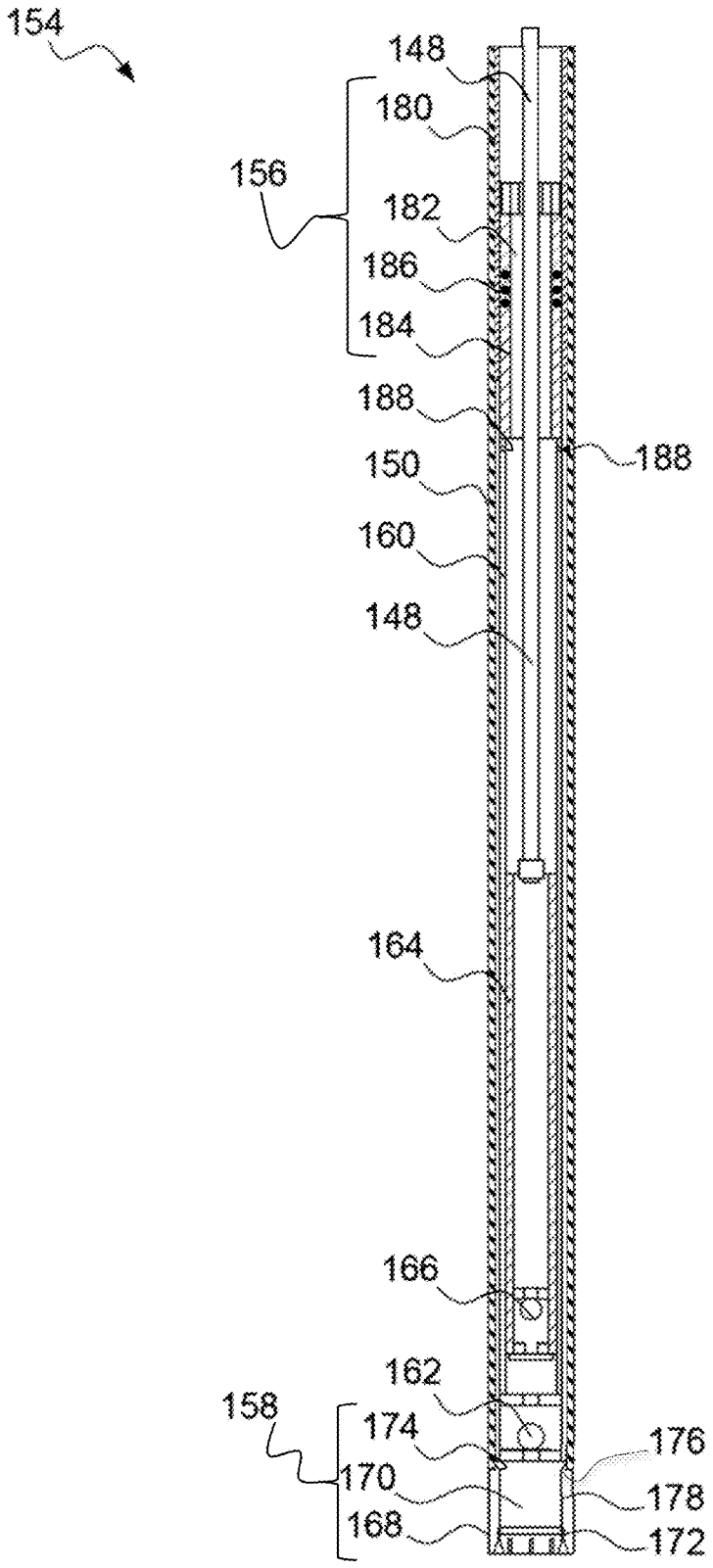
FIG. 2 a partial cross-sectional view of the reciprocating pump of FIG. 1 with a first pump barrel.

Turning to FIG. 2, shown therein are partial cross-sectional views of the reciprocating pump 154. The reciprocating pump 154 is an insert type pump that has been deployed through the production tubing 150. The reciprocating pump 154 includes an upper seating assembly 156, a lower seating assembly 158, a pump barrel 160, a standing valve 162 and a plunger 164. It will be appreciated that the key components of the reciprocating pump 154 are depicted in FIG. 2, but that additional components may be incorporated within the reciprocating pump 154 without deviating from the objects of the present invention. For example, the reciprocating pump 154 may include bushings, extensions, fittings, threaded connections and other components not illustrated in the simplified version of the reciprocating pump 154 depicted in FIG. 2.

The plunger 164 is connected to the sucker rod string 148 and reciprocates within the pump barrel 160. The plunger 164 includes a traveling valve 166 that opens when the pressure below the plunger 164 exceeds the hydrostatic pressure above the traveling valve 166. In a reciprocating cycle of the reciprocating pump 154, fluids from the well 146 are lifted by suction within the production tubing 150 during the rod string 148 upstroke. In accordance with well-established rod lift pump design, the stationary standing valve 162 opens and the traveling valve 166 closes near the bottom of the pump stroke, as the traveling valve 166 begins to move upward. As the standing valve 162 opens, fluid from within the well casing 152 enters the pump barrel 160. As the plunger 164 and the traveling valve 166 near the top of the stroke, the standing valve 162 closes, preventing fluid in the pump barrel 160 from draining back into the well casing 152. As the traveling valve 166 returns toward the standing valve 162, the traveling valve 166 opens to allow fluid in the pump barrel 160 to pass through the traveling valve 166. Once the reciprocating pump 154 begins the next cycle, the traveling valve 166 closes to lift the fluid above the traveling valve 166 through the production tubing 150.

In the embodiment depicted in FIG. 2, the standing valve 162 is connected to the bottom of the pump barrel 160. In other embodiments, the standing valve 162 can be incorporated within the pump barrel 160. The pump barrel 160 may be of a thin-walled or thick-walled construction.

Figure 3:
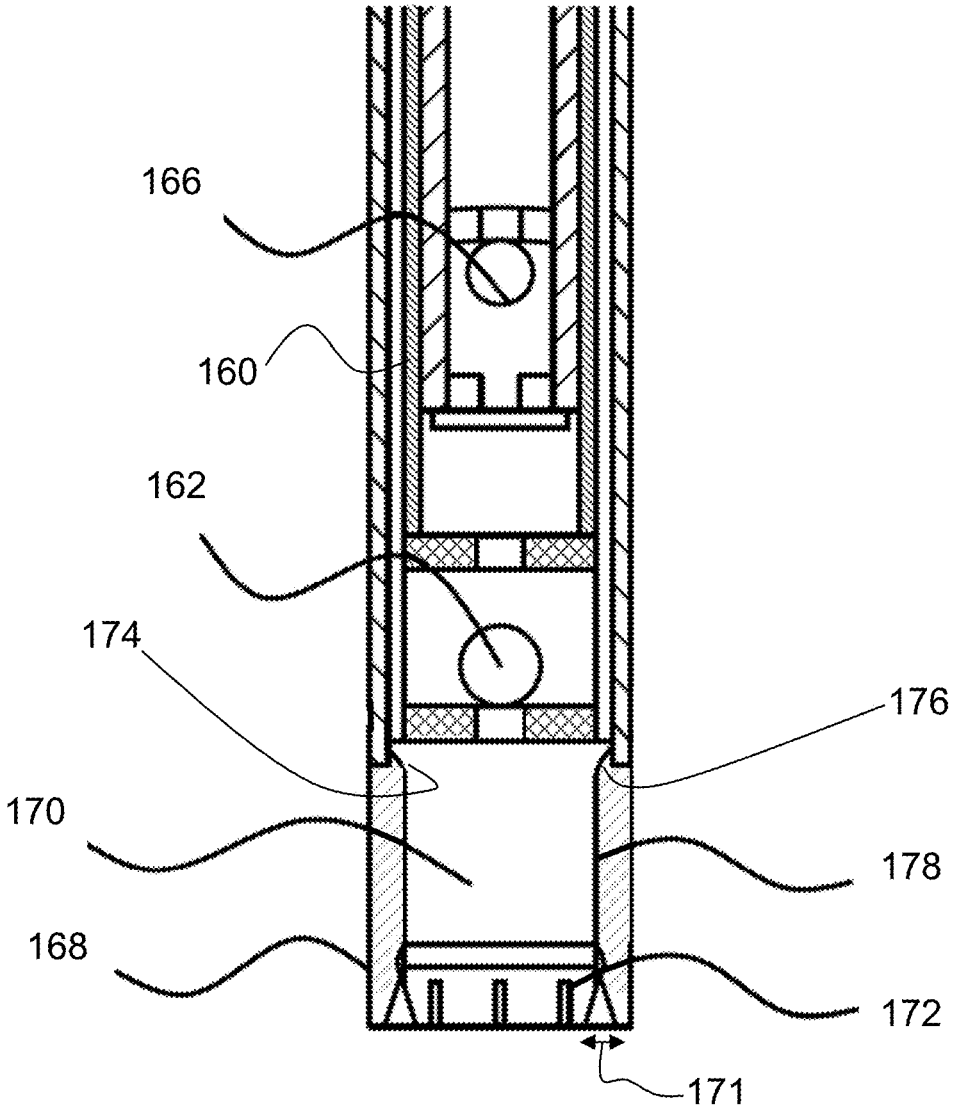
FIG. 3 is a close-up view of the partial cross-section shown in FIG. 2 pointing out elements of the lower seating assembly.

The lower seating assembly 158 includes a lower seating nipple 168 and a lower hold-down 170. The lower seating nipple 168 is secured with a threaded connection to a section of the production tubing 150. The lower hold-down 170 is connected to the bottom of the standing valve 162 or the bottom of the pump barrel 160. In exemplary embodiments, the lower hold-down 170 and lower seating nipple 168 are configured for a mechanical locking engagement. In some embodiments, the lower hold-down 170 includes a plurality of spring-loaded prongs 172 and a shoulder 174. The lower seating nipple 168 includes a corresponding seat 176 and throat 178. As the shoulder 174 approaches the seat 176, the prongs 172 are compressed as they pass through the throat 178. Once the shoulder 174 of the lower hold-down 170 is fully seated against the seat 176 of the lower seating nipple 168, the prongs 172 are beyond the throat 178 and are allowed to expand, thereby preventing the lower hold-down 170 from being unintentionally pulled out of the lower seating nipple 168 (see expansion range shown in FIG. 3, marked by reference number 171). In this way, the lower seating assembly 158 provides a robust anchor to prevent the stationary components of the reciprocating pump 154 from shifting inside the production tubing 150.

The upper seating assembly 156 includes an upper seating nipple 180 and an upper hold-down 182. Unlike the lower seating nipple 168, the upper seating nipple 180 includes a smooth inner cylindrical surface that has a substantially constant diameter that closely matches the outer diameter of the upper hold-down 182. The upper seating nipple 180 is not configured for a mechanical latching engagement with a corresponding hold-down. The upper seating nipple 180 is significantly longer than the lower seating nipple 168. In some embodiments, the upper seating nipple 180 is more than twice as long as the lower seating nipple 168. In other embodiments, the upper seating nipple 180 is more than four times as long as the lower seating nipple 168. In these embodiments, the upper seating nipple 180 is longer than the upper hold-down 182. In some embodiments, the upper seating nipple 180 is more than twice as long as the upper hold-down 182.

The upper hold-down 182 includes a body 184 and one or more seals 186. The seals may include flexible cup-type seals that provide a frictional interface against the upper seating nipple 180. The upper hold-down 182 is connected to the upper end of the pump barrel 160, or to intermediate components between the pump barrel 160 and the upper hold-down 182.

Importantly, the upper hold-down 182 does not include the standard "no-go" flange that prevents most conventional hold-downs from passing through a corresponding seating nipple. Instead, the upper hold-down 182 is capable of passing through the inside of the upper seating nipple 180 such that the seals 186 are compressed against the inner diameter of the upper seating nipple 180. In this way, the upper hold-down 182 can be positioned in a variety of positions within the upper seating nipple 180 while maintaining a sealed engagement that prevents sand or other solid particles from passing into the annular space surrounding the outside of the pump barrel 160.

Thus, upper and lower seating assemblies (156, 158) cooperate to secure the reciprocating pump 154 within the production tubing 150, while preventing sand or other particulates from becoming trapped in the annular space surrounding the reciprocating pump 154. Furthermore, because the upper seating nipple 180 is much longer than the upper hold-down 182 and because the upper hold-down 182 does not include a no-go flange, the upper hold-down 182 can be positioned at a variety of depths within the upper seating nipple 180. The elongated upper seating nipple 180 provides a larger landing space to land the seals 186 of the upper hold-down 182, thereby significantly reducing spacing errors and improving the likelihood of accurately landing the seals 186 during installation of the reciprocating pump 154. The elongated upper seating nipple 180 also simplifies the installation of pump barrels 160 that may differ in length because it eliminates or reduces the need for spacing subs to adjust the length of the reciprocating pump 154 between the upper and lower hold-downs (182, 170).

The reciprocating pump 154 optionally includes one or more pressure communication ports 188 that permit an exchange of fluid between the interior and the exterior of the reciprocating pump 154. As depicted in the embodiment of FIG. 2, the communication ports 188 are positioned just below the upper hold-down 182 and extend through the wall of the pump barrel 160. It will be appreciated that the pressure communication ports 188 can be positioned at various locations along the length of the pump barrel 160 and distributed at spaced distances around the circumference of the pump barrel 160. The one or more pressure communication ports 188 reduce pressure imbalances between the inside of the pump barrel 160 and the exterior annular space surrounding the pump barrel 160. Reducing the pressure gradients across the pump barrel 160 reduces the burst risk associated with high pressure installations and permits the use of thinner walled pump barrels in deeper, high pressure applications. Thus, the use of the pressure communication ports 188 will find particular benefit for reciprocating pumps 154 that employ thin-walled pump barrels 160.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A downhole reciprocating pump configured for deployment within a tubing string, the reciprocating pump comprising:

a pump barrel;

a plunger inside the pump barrel;

a lower seating nipple connected within a lower portion of the tubing string;

a lower hold-down connected to the pump barrel, wherein the lower hold-down is configured for a mechanical latching engagement with the lower seating nipple, the mechanical latching arrangement comprising a plurality of prongs on the lower hold-down that expand within the lower seating nipple;

an upper seating nipple connected within the tubing string above the lower seating nipple, wherein the upper seating nipple is longer than the lower seating nipple; and an upper hold-down, wherein the upper hold-down includes one or more seals that contact an interior surface of the upper seating nipple.

2. The downhole reciprocating pump of claim 1, wherein the upper seating nipple is twice as long as the lower seating nipple.

3. The downhole reciprocating pump of claim 2, wherein the upper seating nipple is four times as long as the lower seating nipple.

4. The downhole reciprocating pump of claim 1, wherein the upper hold-down comprises a plurality of cup seals.

5. The downhole reciprocating pump of claim 1, wherein the upper hold-down is configured to pass through the interior surface of the upper seating nipple.

6. The downhole reciprocating pump of claim 1, further comprising one or more pressure communication ports extending though the pump barrel.

7. The downhole reciprocating pump of claim 6, wherein the one or more pressure communication ports are positioned in the pump barrel adjacent to and below the upper hold-down.

8. A method for servicing a reciprocating downhole pump, the method comprising the steps of:

installing upper and lower seating nipples at fixed locations within a tubing string;

deploying a reciprocating pump inside the tubing string, wherein the reciprocating pump comprises a pump barrel, an upper hold-down and a lower hold-down;

securing the reciprocating pump at a position within the tubing string by mechanically securing the lower hold-down within the lower seating nipple; and sealing an annular space surrounding the reciprocating pump with a sealing engagement between the upper hold-down and the upper seating nipple, operating the reciprocating pump, and retrieving the reciprocating pump through the tubing string, wherein the step of retrieving the reciprocating pump further comprises forcibly freeing the lower hold-down from the lower seating nipple, and wherein the step of mechanically securing the lower hold-down within the lower seating nipple comprises permitting a plurality of prongs within the lower hold-down to expand within the lower seating nipple, and wherein the step of forcibly freeing the lower hold-down comprises retracting the plurality of prongs within the lower hold-down.

9. The method of claim 8, wherein the step of sealing an annular space surrounding the reciprocating pump further comprises compressing one or more seals within the upper hold-down against the upper seating nipple.

10. A method for servicing a reciprocating downhole pump, the method comprising the steps of:

installing upper and lower seating nipples at fixed locations within a tubing string;

deploying a reciprocating pump inside the tubing string, wherein the reciprocating pump comprises a pump barrel, an upper hold-down and a lower hold-down;

securing the reciprocating pump at a position within the tubing string by mechanically securing the lower hold-down within the lower seating nipple; and sealing an annular space surrounding the reciprocating pump with a sealing engagement between the upper hold-down and the upper seating nipple, wherein the step of sealing an annular space surrounding the reciprocating pump further comprises compressing one or more seals within the upper hold-down against the upper seating nipple, and wherein the step of compressing one or more seals within the upper hold-down further comprises sliding the one or more seals within the upper hold-down from contact with an upper portion of the upper seating nipple to contact with a lower portion of the upper seating nipple.

11. A downhole reciprocating pump configured for deployment within a tubing string, the reciprocating pump comprising:

a pump barrel having a wall, an upper end, and a lower end;

a plunger inside the pump barrel;

a lower seating nipple connected within a lower portion of the tubing string;

a lower hold-down connected to the lower end of the pump barrel, wherein the lower hold-down is configured for a mechanical latching engagement with the lower seating nipple, the mechanical latching arrangement comprising a plurality of prongs on the lower hold-down that expand within the lower seating nipple;

an upper seating nipple connected within the tubing string above the lower seating nipple;

an upper hold-down, wherein the upper hold-down comprises:

a body connected to the upper end of the pump barrel, and one or more seals that contact an interior surface of the upper seating nipple; and one or more pressure communication ports, wherein the one or more pressure communication ports extend through the wall of the pump barrel.

12. The downhole reciprocating pump of claim 11, wherein the upper seating nipple is longer than the lower seating nipple.

13. The downhole reciprocating pump of claim 12, wherein the upper seating nipple is twice as long as the lower seating nipple.

14. The downhole reciprocating pump of claim 12, wherein the upper seating nipple is four times as long as the lower seating nipple.

15. The downhole reciprocating pump of claim 11, wherein the upper hold-down comprises a plurality of cup seals.

16. The downhole reciprocating pump of claim 11, wherein the one or more pressure communication ports are positioned in the pump barrel adjacent to and below the upper hold-down.

* * * * *